US005747219A

United States Patent [19]

Febonio et al.

[11] Patent Number: 5,747,219

[45] Date of Patent: May 5, 1998

[54] IMAGE-RECEIVING ELEMENTS

[75] Inventors: Robert L. Febonio, Hudson, N.H.; James A. Foley, Wellesley, Mass.

[73] Assignee: Polaroid Corporation, Cambridge, Mass.

[21] Appl. No.: 890,500

[22] Filed: Jul. 9, 1997

[51] Int. Cl.[6] ..... G03C 8/52; G03C 8/26

[52] U.S. Cl. ..... 430/215; 430/221; 430/227; 430/236; 430/244; 428/411.1; 428/484

[58] Field of Search ..... 430/215, 221, 430/227, 236, 244; 428/484, 411.1

[56] References Cited

U.S. PATENT DOCUMENTS 3,415,644 12/1968 Land ..... 430/220
3,647,437 3/1972 Land ..... 430/221
4,294,907 10/1981 Bronstein-Bonte et al. ..... 430/215
4,298,674 11/1981 Land et al. ..... 430/213
4,777,112 10/1988 La Pointe ..... 430/215

*Primary Examiner*—Richard L. Schilling
*Attorney, Agent, or Firm*—Jennifer A. Kispert

[57] ABSTRACT

There are described novel image-receiving elements for use in diffusion transfer photographic systems. The novel image-receiving elements include a layer capable of reducing the light-absorbing capacity of an optical filter agent. The layer comprises nonylphenoxypolyoxyethylene and polyoxyethylene stearate.

Diffusion transfer photographic systems utilizing the novel image-receiving elements of the present invention exhibit substantial clearing of optical filter agents during about the first five minutes of photographic processing, enabling the viewing of the emerging image against a whiter, brighter background, and show substantially diminished haze in the film coatings.

35 Claims, No Drawings

IMAGE-RECEIVING ELEMENTS

This invention relates to novel diffusion transfer films and processes, and, more specifically, to a novel image-receiving element comprising a support which carries an image-receiving layer and a layer over the image-receiving layer, remote from the support, which contains two clearing agents capable of reducing the light-absorbing capacity of an optical filter agent.

BACKGROUND OF THE INVENTION

Diffusion transfer photographic processes are well known in the art. Such processes have in common the feature that the final image is a function of the formation of an imagewise distribution of an image-providing material and the diffusion transfer of the imagewise distribution to an image-receiving layer. In general, a diffusion transfer image is obtained first by exposing to actinic radiation a photosensitive element, or negative film component, which comprises at least one light-sensitive silver halide layer, to form a developable image. Thereafter, this image is developed by applying an aqueous alkaline processing fluid to form an imagewise distribution of soluble and diffusible image dye-providing material, and transferring this imagewise distribution by diffusion to a superposed image-receiving layer of an image-receiving element, or positive film component, to impart a transfer image thereto.

The aqueous processing compositions employed in diffusion transfer processes are usually highly alkaline (e.g., above about pH 12). After processing has been allowed to proceed for a predetermined period of time, it is desirable to neutralize the alkali of the processing composition to prevent further development and image dye transfer, and, in some instances, subsequent oxidation which may have a material and substantial effect upon the stability to light of the resulting image in the image-receiving layer. Accordingly, a neutralizing layer, typically a nondiffusible acid-reacting reagent, is employed in the film unit to lower the pH from a first (high) pH of the processing composition to a predetermined second (lower) pH.

To ensure that the pH reduction occurs after a sufficient, predetermined period and not prematurely so as to interfere with the development process, e.g., stop the transfer of image dyes which may result in, for example, a pale, i.e., low density, image of undesirable color balance, a timing layer is typically positioned before the neutralization layer.

Diffusion transfer photographic materials known in the art include those wherein the photosensitive silver halide emulsion layer(s) and the image-receiving layer are initially contained in separate elements which are brought into superposition subsequent or prior to exposure. Alternatively, the photosensitive layer(s) and the image-receiving layer may initially be in a single element wherein the photosensitive and image-receiving components are retained together in an integral negative-positive structure. In either case, after development the two elements may be retained together in a single film unit, i.e., often referred to an integral film unit.

As described, for example, in U.S. Pat. No. 3,415,644, diffusion transfer photographic film units are known where the photosensitive and image-receiving elements are maintained in superposed relationship before, during and after exposure and image formation. Embodiments of such film units include those wherein the support for the photosensitive element is opaque, the support for the image-receiving element is transparent and a light-reflecting layer against which the image formed in the image-receiving layer may be viewed is formed by distributing a layer of aqueous alkaline processing composition containing a light-reflecting pigment, generally titanium dioxide, between the superposed elements. In such film units, the final image is viewed through the transparent support of the image-receiving element against a reflecting, i.e., white, background, provided by the, e.g., titanium dioxide.

By also incorporating suitable optical filter agents, such as, for example, pH-sensitive optical filter agents such as pH-sensitive dyes, e.g., pH-sensitive phthalein dyes, in the aqueous alkaline processing composition comprising the light-reflecting pigment, as described, for example, in U.S. Pat. No. 3,647,347, the film unit may be ejected from the camera immediately after the aqueous alkaline processing composition has been applied with the process being completed in ambient light while the photographer watches the transfer image emerge. The optical filter agent(s) is selected to exhibit the appropriate light absorption, i.e., optical density, over the wavelength range of light actinic to the particular, e.g., silver halide emulsion.

The concentrations of the light-reflecting pigment and the optical filter agent are chosen such that the layer of aqueous alkaline processing composition is sufficiently opaque to light actinic to the, e.g., silver halide emulsion, derived from, for example, the ambient light incident to and transmitted through the transparent support of the image-receiving element of the integral film unit. The light-absorbing capacity of the optical filter agent is cleared after this capacity is no longer needed, so that the optical filter agent need not be removed from the film unit, i.e., the optical filter agent will not exhibit any visible absorption which could degrade the transfer image or the white background provided by the reflecting layer.

Methods for "discharging" or "clearing" the light-absorbing capacity of particular optical filter agents are known in the art, such as, for example, as described in U.S. Pat. No. 4,298,674 where the optical filter agent, i.e., a pH-sensitive dye, is cleared by: (1) a pH reduction effected by an acid-reacting reagent, or, (2) a neutral polymeric material or a polyether polymer, the materials being appropriately positioned within the film unit such that neither the acid-reacting reagent nor the neutral polymeric material or the polyether polymer reduce the pH within the processing composition layer nor cause premature reduction in the light-absorbing capacity of the optical filter agent therein.

U.S. Pat. No. 4,298,674 describes the addition of certain suitable decolorizing agents, such as, for example, a polyoxyethylene polyoxypropylene block copolymer or a polyoxyethylene polymer, e.g., nonylphenoxypolyoxyethylene, which "decolorize" or "clear" the pH-sensitive optical filter agent.

While such materials have been found to provide advantageous results as are described in the above-mentioned patents; nevertheless, their performance in some photographic systems is not completely satisfactory, such as, for example, where it is desirable to begin to "clear" the light-absorbing capacity of the optical filter agent more quickly, e.g., within about the first five minutes of photographic processing. The quicker clearing of the optical filter agent enables the photographer, e.g., to view the emerging image, or dyes comprising the image, against a whiter, brighter background.

As the state of the art for photographic systems advances, novel techniques and materials continue to be developed by those skilled in the art in order to attain the performance criteria required of such materials. There is a need for novel materials that have advantages over those already known to the art; hence, investigations continue to be pursued to provide such advantages.

Accordingly, the present invention relates to a novel image-receiving element for use in a diffusion transfer process which includes a layer comprising nonylphenoxypolyoxyethylene and polyoxyethylene stearate compounds which substantially diminishes haze in the coated film, i.e., less of the incident light used to expose the film is diffracted, and substantially reduces or clears the light-absorbing capacity of the pH-sensitive optical filter agent during about the first five minutes of photographic processing, enabling the viewing of the emerging image against a whiter, brighter background.

SUMMARY OF THE INVENTION

These and other objects and advantages are accomplished in accordance with the invention by providing a novel image-receiving element for use in a diffusion transfer process which comprises a support carrying an image-receiving layer and a layer which includes two clearing agents capable of reducing the light-absorbing capacity of an optical filter agent.

The layer which includes the clearing agents is coated over the image-receiving layer of the image-receiving element, remote from the support, and may be arranged at different locations within the image-receiving element. The layer may be adjacent or non-adjacent to the image-receiving layer. It is preferred that the layer be located adjacent to the image-receiving layer of the image-receiving element, remote from the support.

The layer may be used in conjunction with any photographic emulsion. Moreover, the layer may be used during the photographic processing of any exposed photosensitive element including photographic systems for forming images in black and white or in color and those wherein the final image is a metallic silver image or one formed by other image-forming materials, such as, for example, image dye-providing materials.

It has been found that the use of a diffusion transfer photographic film unit which includes the novel image-receiving element substantially diminishes haze in the coated film, i.e., less of the incident light used to expose the film is diffracted, and begins to substantially reduce or clear the light-absorbing capacity of the pH-sensitive optical filter agent during about the first five minutes of photographic processing, enabling the viewing of the emerging image against a whiter, brighter background.

These and other objects and advantages which are provided in accordance with the invention will in part be obvious and in part be described hereinafter in conjunction with the detailed description of various preferred embodiments of the invention. The invention accordingly comprises the processes involving the several steps and relation and order of one or more of such steps with respect to each of the others, and the product and compositions possessing the features, properties and relation of elements which are exemplified in the following detailed disclosure, and the scope of the application of which will be indicated in the claims.

For a fuller understanding of the nature and objects of the invention, reference should be had to the following detailed description of the preferred embodiments.

DESCRIPTION OF THE PREFERRED EMBODIMENTS

The nonylphenoxypolyoxyethylene and polyoxyethylene stearate compounds which are suitable for use in the present invention are known compounds, e.g., see McCutcheon's, Volume 1, *Emulsifiers and Detergents*, page 147, North American Ed. (1995) and, as such, may be prepared using techniques which are well known to those of skill in organic chemistry and in the polymer art. It will be appreciated by those of ordinary skill in the art that any suitable method for preparing the nonylphenoxypolyoxyethylene and polyoxyethylene stearate compounds included in the clearing layer of the present invention may be utilized.

The process of grafting polyethylene oxide on small molecules to make non-ionic surfactants is well known in the art, such as, for example, grafts of ethylene oxide to p-alkylphenols, e.g., Igepal® or Triton® X-100. As is also known to the art, the above-mentioned grafting is applied to a number of substrates including polymer surfaces and small molecules, and the chain lengths of the ethylene oxide units, referred to as polyethylene glycol or "PEG" units, generally are not appreciably lengthy. As is understood by those of skill in the relevant art, when a material has the modifier "PEG," a low molecular weight polyethylene oxide or "PEG" has been grafted to it, i.e., the materials have been "pegylated."

As is known in the art, for example, as described in U.S. Pat. No. 4,298,674, nonylphenoxypolyoxyethylene may be included in a clearing layer incorporated in a diffusion transfer photographic film unit.

In a preferred embodiment nonylphenoxypolyoxyethylene is represented by formula (a):

(a)

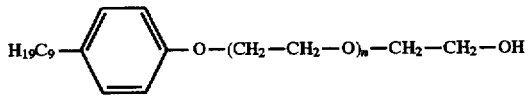

wherein: n is an integer from about 40 to about 120. In a preferred embodiment n is an integer from about 80 to about 120. In a particularly preferred embodiment, n is an integer from about 90 to about 110. In an especially preferred embodiment n is about 99.

In a preferred embodiment polyoxyethylene stearate is represented by formula (b):

(b)

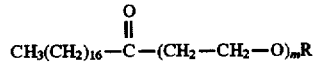

wherein: R is selected from the group consisting of: $^{-}OOC-(CH_2)_{16}CH_3$ and $-CH_2-CH_2-OH$; and m is an integer from about 40 to about 180, when R is $-CH_2-CH_2-OH$; and m is an integer from about 40 to about 200 when R is $^{-}OOC-(CH_2)_{16}CH_3$. When R is $-CH_2-CH_2-OH$, m is preferably an integer from about 80 to about 160, particularly preferably from about 90 to about 150, and especially preferably about 99. When R is $^{-}OOC-(CH_2)_{16}CH_3$, m is preferably an integer from about 100 to about 160, particularly preferably from about 125 to about 150, and especially preferably about 136.

Suitable nonylphenoxypolyoxyethylene compounds are commercially available, such as, for example, under the tradenames Igepal® CO-997 ("n" of (a) herein is about 99) and Igepal® CO-890 ("n" of (a) herein is about 39) from the General Dyestuff Corporation (New York, N.Y.). It is particularly preferred to use Igepal® CO-997.

Suitable polyoxyethylene stearate compounds are commercially available, such as, for example, under the tradenames Myrj® 59 ("m" of (b) herein is about 99, R is $-CH_2-CH_2-OH$) from ICI Americas, Inc. (Wilmington, Del.) and Mapeg® 6000 DS ("m" of (b) herein is about 136, R is $^{-}OOC—(CH_2)_{16}CH_3$) from PPG Industries (Gurnee, Ill.).

The nonylphenoxypolyoxyethylene and polyoxyethylene stearate compounds included in the clearing layer of the present invention may be used in any amount which is required to accomplish their intended purpose, e.g., to reduce the light-absorbing capacity of a pH-sensitive optical filter agent. It will be appreciated by those of ordinary skill in the art that the amount of clearing agents necessary in any specific instance is dependent upon a number of factors such as, for example, the specific light-reflecting pigment and/or pH-sensitive optical filter agent utilized, the type of diffusion transfer film unit and the result desired, e.g., visual brightness or whiteness of the background against which the image begins to become visible during about the first five minutes of photographic processing.

The novel image-receiving element of the present invention includes a support carrying an image-receiving layer and a clearing layer comprising nonylphenoxypolyoxyethylene and polyoxyethylene stearate. The clearing layer may also include any suitable binder material. The clearing layer may further include additional polyoxyethylene stearate compounds.

In a preferred embodiment the clearing layer of the present invention comprises from about 9% to about 55% by weight of nonylphenoxypolyoxyethylene, and from about 25% to about 70% by weight of polyoxyethylene stearate, wherein the amount of polyoxyethylene stearate may be attributed to one or more polyoxyethylene stearate compounds of formula (b).

In a preferred embodiment of the present invention the layer which includes the clearing agents further includes a binder material. The binder material may be any suitable binder material as is well known in the art. In such embodiments it is particularly preferred to include a binder material which itself is effective in decolorizing the optical filter agents employed. For example, it is well known in the art, e.g., as described in U.S. Pat. No. 4,298,674, that poly-N-vinyl-pyrrolidone is effective in decolorizing phthalein dyes. It is preferred to use poly-N-vinyl-pyrrolidone as the binder material.

In a preferred embodiment of the present invention the layer which includes the clearing agents comprises from about 9% to about 55% by weight of nonylphenoxypolyoxyethylene, from about 25% to about 75% by weight of polyoxyethylene stearate, and from about 20% to about 35% by weight of other suitable binder materials. It is preferred to use poly-N-vinyl-pyrrolidone as the binder material. It is particularly preferred to use poly-N-vinyl-pyrrolidone commercially available from the GAF Corp. (Wayne, N.J.) under the tradenames Type NP K-90 or Type NP K-120 as the binder material.

Preferred weight ratios of nonylphenoxypolyoxyethylene to polyoxyethylene stearate are from about 1:9 to about 3:7. Particularly preferred weight ratios of nonylphenoxypolyoxyethylene to polyoxyethylene stearate are from about 1:3 to about 1:2. An especially preferred weight ratio of nonylphenoxypolyoxyethylene to polyoxyethylene stearate is about 1:1.5. As mentioned earlier, the amount of polyoxyethylene stearate included in the layer which includes the clearing agents may be attributable to one or more polyoxyethylene stearate compounds.

Preferred weight ratios of clearing agents, i.e., the amount of the nonylphenoxypolyoxyethylene compound and the polyoxyethylene stearate compound(s) taken together, to binder material are from about 4:1 to about 1.5:1. Particularly preferred weight ratios of clearing agents to binder material are from about 3:1 to about 2:1. An especially preferred weight ratio of clearing agents to binder material is about 2:1. It would be appreciated by one of ordinary skill in the art that routine scoping tests may be conducted to ascertain the concentrations of clearing agents and binder material which are appropriate for any given photographic element.

Any suitable pH-sensitive optical filter agent may be used in the diffusion transfer photographic film units of the present invention. It is preferred to use a phthalein indicator dye as the pH-sensitive optical filter agent. It is particularly preferred to use a pH-sensitive optical filter agent selected from the following group:

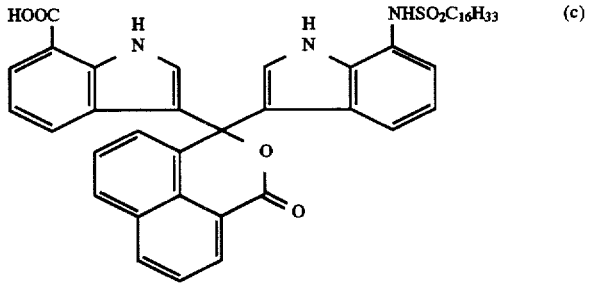

(c)

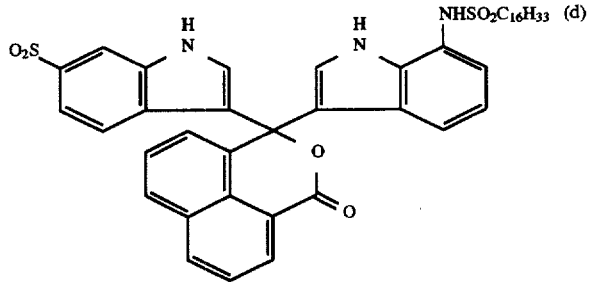

(d)

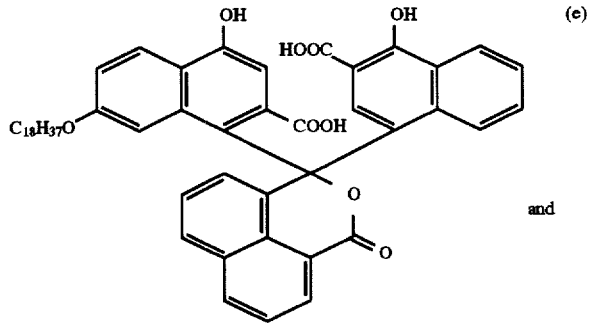

(e)

and

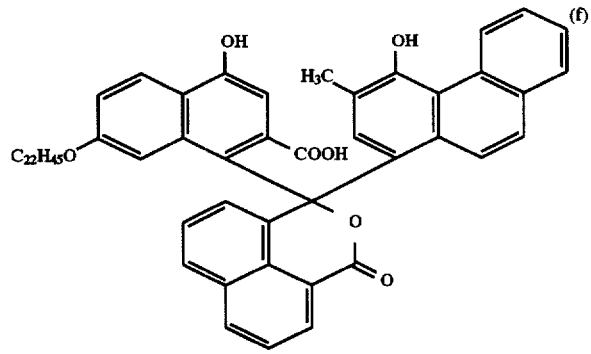

(f)

There are provided according to the present invention diffusion transfer photographic film units. The layer which includes the clearing agents is coated over the image-receiving layer of the image-receiving element, remote from the support, and may be arranged at different locations within the image-receiving element. The layer may be adjacent or non-adjacent to the image-receiving layer. It is preferred that the layer be located adjacent to the image-receiving layer of the image-receiving element, remote from the support.

The layer which includes the clearing agents of the present invention may be used during the photographic processing of any exposed photosensitive element including photographic systems for forming images in black and white or in color and those wherein the final image is a metallic silver image or one formed by other image-forming materials.

Image-recording elements useful in both black and white and color photographic imaging systems are well known in the art and, therefore, extensive discussion of such materials is not necessary. It should be noted, however, that although the diffusion transfer film unit of the present invention is preferably used in photographic systems which include a rupturable container or "pod," as is known in the art, which releasably contains an aqueous alkaline processing composition; nonetheless, the diffusion transfer film unit of the present invention may also be used in photographic systems which do not utilize a pod.

In addition, the layer of the present invention may be used in conjunction with any photographic emulsion. In the preferred diffusion transfer film units of the invention, it is preferred to include a negative working silver halide emulsion, i.e., one which develops in the areas of exposure. Further, the layer of the invention may be used in association with any image dye-providing materials, for example, complete dyes or dye intermediates, e.g., color couplers, or dye-developers. The dye developers contain, in the same molecule, both the chromophoric system of a dye and a silver halide developing function as is described in U.S. Pat. No. 2,983,606.

In a particularly preferred embodiment the diffusion transfer photographic film elements of the invention include one or more image dye-providing materials which may be initially diffusible or nondiffusible. In diffusion transfer photographic systems the image dye-providing materials which can be utilized generally may be characterized as either (1) initially soluble or diffusible in the processing composition but which are selectively rendered nondiffusible imagewise as a function of development or (2) initially insoluble or nondiffusible in the processing composition but which selectively provide a diffusible product imagewise as a function of development. The requisite differential in mobility or solubility may be obtained, for example, by a chemical reaction such as a redox reaction as is the case with dye developers, a coupling reaction or by a silver-assisted cleavage reaction as is the case with thiazolidines. As noted previously, more than one image-forming mechanism may be utilized in the multicolor diffusion transfer film units of the present invention.

Other image dye-providing materials which may be used include, for example, initially diffusible coupling dyes such as are useful in the diffusion transfer process described in U.S. Pat. No. 2,087,817 which are rendered nondiffusible by coupling with the oxidation product of a color developer; initially nondiffusible dyes which release a diffusible dye following oxidation, sometimes referred to as "redox dye releaser" dyes, described in U.S. Pat. Nos. 3,725,062 and 4,076,529; initially nondiffusible image dye-providing materials which release a diffusible dye following oxidation and intramolecular ring closure as are described in U.S. Pat. No. 3,433,939 or those which undergo silver assisted cleavage to release a diffusible dye in accordance with the disclosure of U.S. Pat. Nos. 3,719,489 and 5,569,574; and initially nondiffusible image dye-providing materials which release a diffusible dye following coupling with an oxidized color developer as described in U.S. Pat. No. 3,227,550. In a particularly preferred embodiment of the invention the image dye-providing materials are dye-developers which are initially diffusible materials.

U.S. Pat. Nos. 3,719,489 and 4,098,783 disclose diffusion transfer processes wherein a diffusible image dye is released from an immobile precursor by silver-initiated cleavage of certain sulfur-nitrogen containing compounds, preferably a cyclic 1,3-sulfur nitrogen ring system, and most preferably a thiazolidine compound. For convenience, these compounds may be referred to as "image dye-releasing thiazolidines". The same release mechanism is used for all three image dyes, and, as will be readily apparent, the image dye-forming system is not redox controlled.

U.S. Pat. No. 5,569,574 discloses diffusion transfer processes wherein a diffusible image dye is released from an immobile precursor by silver-initiated cleavage of certain sulfur-oxygen containing compounds, preferably, a 1,3-sulfur-oxygen ring system.

A technique which utilizes two different imaging mechanisms, namely dye developers and image dye-releasing thiazolidines, is described U.S. Pat. Nos. 4,777,112; 4,794,067 and 5,422,233, and is described and claimed in U.S. Pat. No. 4,740,448. According to this process the image dye positioned the greatest distance from the image-receiving layer is a dye developer and the image dye positioned closest to the image-receiving layer is provided by an image dye-releasing thiazolidine. The other image dye-providing material may be either a dye developer or an image dye-releasing thiazolidine. Particularly preferred diffusion transfer film units according to the present invention include, as image dye-providing materials, both dye developers and dye-providing thiazolidine compounds as described in U.S. Pat. No. 4,740,448.

The diffusion transfer photographic systems utilizing the diffusion transfer film units of the present invention may include any of the known diffusion transfer multicolor films. Particularly preferred diffusion transfer photographic film units according to the invention are those intended to provide multicolor dye images.

The most commonly employed photosensitive elements for forming multicolor images are of the "tripack" structure and contain blue-, green- and red-sensitive silver halide emulsion layers each having associated therewith in the same or a contiguous layer a yellow, a magenta and a cyan image dye-providing material, respectively.

Suitable photosensitive elements and their use in the processing of diffusion transfer photographic images are well known and are disclosed, for example, in U.S. Pat. No. 2,983,606; and in U.S. Pat. Nos. 3,345,163 and 4,322,489.

U.S. Pat. No. 2,983,606 discloses a subtractive color film which employs red-sensitive, green-sensitive and blue-sensitive silver halide layers having associated therewith, respectively, cyan, magenta and yellow dye developers. In such films, oxidation of the dye developers in exposed areas and consequent immobilization thereof has provided the mechanism for obtaining imagewise distribution of unoxidized, diffusible cyan, magenta and yellow dye developers which are transferred by diffusion to an image-receiving layer. While a dye developer itself may develop exposed silver halide, in practice the dye developer process has utilized a colorless developing agent, sometimes referred to as an "auxiliary" developer, a "messenger" developer or an "electron transfer agent", which developing agent develops the exposed silver halide. The oxidized developing agent then participates in a redox reaction with the dye developer thereby oxidizing and immobilizing the dye developer in imagewise fashion. A well known messenger developer has been 4'-methylphenylhydroquinone. Commercial diffusion transfer photographic films of Polaroid Corporation including Polacolor® SX-70, Time Zero® and 600 have used cyan, magenta, and yellow dye developers.

The diffusion transfer photographic materials of the present invention include those wherein the photosensitive silver halide emulsion layer(s) and the image-receiving layer are initially contained in separate elements which are brought into superposition subsequent or prior to exposure. Alternatively, the photosensitive layer(s) and the image-receiving layer may initially be in a single element wherein the photosensitive or "negative" and image-receiving or "positive" components are retained together in an integral structure. In either case, after development the two elements may be retained together in a single film unit, i.e., an integral negative-positive film unit.

As stated above, the multicolor diffusion transfer photographic film units of the invention include those where the photosensitive element and the image-receiving element are maintained in superposed relationship before, during and after exposure as described in U.S. Pat. No. 3,415,644. In commercial embodiments of this type of film (e.g., SX-70 film) the support for the photosensitive element is opaque, the support for the image-receiving element is transparent and a light-reflecting layer against which the image formed in the image-receiving layer may be viewed is formed by distributing a layer of processing composition containing a light-reflecting pigment (titanium dioxide) between the superposed elements. As mentioned earlier, by also incorporating suitable pH-sensitive optical filter agents, preferably pH-sensitive phthalein dyes, in the processing composition, as described in U.S. Pat. No. 3,647,347, the film unit may be ejected from the camera immediately after the processing composition has been applied with the process being completed in ambient light while the photographer watches the transfer image emerge.

As noted above, subtractive multicolor diffusion transfer films comprise a blue-sensitive silver halide emulsion in association with a yellow image dye, a green-sensitive silver halide emulsion in association with a magenta image dye, and a red-sensitive silver halide emulsion in association with a cyan image dye. Each silver halide emulsion and its associated image dye-providing material may be considered to be a "sandwich", i.e., the red sandwich, the green sandwich and the blue sandwich. Similarly, the associated layers which cooperate (e.g., the red-sensitive silver halide emulsion and its associated cyan dye developer) to create each imagewise distribution of diffusible image dye may be referred to collectively as, e.g., the red image component of the photosensitive element. It should be noted that the particular image component may contain other layers such as interlayers and timing layers.

As stated earlier, the present invention may be practiced with any multicolor diffusion transfer photographic film units and these film units may include any image dye-providing materials. In the particularly preferred embodiments of the invention the cyan and magenta image dyes are dye developers and the yellow image dye is a thiazolidine. In a particularly preferred embodiment the red sandwich, or image component, is positioned closest to the support for the photosensitive element and the blue image component is positioned farthest from the support of the photosensitive element and closest to the image-receiving layer.

The novel image-receiving element of the present invention comprises a support which carries an image-receiving layer and a layer which includes the clearing agents, wherein the clearing agents are nonylphenoxypolyoxyethylene and polyoxyethylene stearate.

Briefly, for example, a preferred embodiment of a photographic diffusion transfer film unit of the present invention wherein the image-receiving element is designed to be maintained with the photosensitive element after exposure and photographic processing typically includes: (1) a photosensitive element comprising a support carrying at least one silver halide emulsion layer and a polymeric acid reacting layer; (2) an image-receiving element comprising a support which carries an image-receiving layer and a layer which includes the clearing agents, and which is superposed or superposable on the photosensitive element; and (3) a rupturable container releasably holding an aqueous alkaline processing composition comprising a light-reflecting pigment and a pH-sensitive optical filter agent and so positioned as to be adapted to distribute the processing composition between predetermined layers of the elements, all prepared as described herein. The photosensitive element mentioned above preferably includes a timing layer and an image dye-providing material in association with said silver halide emulsion layer(s). Each of the known layers carried by the respective supports functions in a predetermined manner to provide desired diffusion transfer photographic processing as is known in the art.

The photosensitive element preferably includes a red-sensitive silver halide emulsion having a cyan image dye-providing material associated therewith, a green-sensitive silver halide emulsion layer having a magenta image dye-providing material associated therewith and a blue-sensitive silver halide emulsion layer having a yellow image dye-providing material associated therewith. In addition, the preferred second sheet-like element or image-receiving element mentioned above may include additional layers such as a strip-coat layer, e.g., as disclosed and claimed in U.S. Pat. No. 5,346,800, and an overcoat layer, e.g., as disclosed and claimed in U.S. Pat. No. 5,415,969, and as is known in the art.

The present invention also provides a novel method for forming a diffusion transfer image which generally includes the steps of:

preparing a diffusion transfer photographic film unit which includes a photosensitive element comprising a support carrying at least one silver halide emulsion layer, and an image-receiving element comprising a support carrying an image-receiving layer and a layer comprising nonylphenoxypolyoxyethylene and polyoxyethylene stearate;

exposing the film unit to an imagewise pattern of radiation;

developing the film unit by providing a layer of aqueous alkaline processing composition comprising a light-reflecting pigment and a light-absorbing optical filter agent between the photosensitive element and the image-receiving element;

reducing the light-absorbing capacity of the light-absorbing optical filter agent comprising the processing composition whereby the surface of the layer of processing composition viewable through the support appears substantially white substantially immediately after the layer of processing composition is applied; and forming an image on the image-receiving layer.

Support material can comprise any of a variety of materials capable of carrying the other layers of image-receiving element. Paper, vinyl chloride polymers, polyamides such as nylon, polyesters such as polyethylene terephthalate, or cellulose derivatives such as cellulose acetate or cellulose acetate-butyrate, can be suitably employed. Depending upon the desired nature of the finished photograph, the nature of support material as a transparent, opaque or translucent material will be a matter of choice. Typically, an image-receiving element adapted to be used in peel-apart diffusion transfer film units and designed to be separated after processing will be based upon an opaque support material.

The support material of the image-receiving element may be a transparent material for the production of a photographic reflection print, and it will be appreciated that support will be a transparent support material where the processing of a photographic transparency is desired. In one embodiment where the support material is a transparent sheet material, an opaque sheet (not shown), preferably pressure-sensitive, can be applied over the transparent support to permit in-light development. Upon photographic processing and subsequent removal of the opaque pressure-sensitive sheet, the photographic image diffused into image-bearing layer can be viewed as a transparency. As mentioned previously, since the support material of the image-receiving element is a transparent sheet, opacification materials such as carbon black and titanium dioxide can be incorporated in the processing composition to permit in-light development.

As mentioned above the preferred film unit includes a pressure-rupturable container. Such pods and like structures are common in the art and generally define the means for providing the processing composition to the photosensitive element and image-receiving element. The processing composition typically comprises an aqueous alkaline composition which may include a silver halide developing agent and other addenda as is known in the art. Examples of such processing compositions are found in U.S. Pat. Nos. 3,445,685; 3,597,197; 4,680,247; 4,756,996 and 5,422,233, as well as the patents cited therein.

In addition, the aqueous alkaline processing composition utilized in the diffusion transfer film units of the invention may include one or more of the acylpyridine-N-oxide compounds as disclosed and claimed in U.S. Pat. No. 5,604,079, and/or inosine as disclosed and claimed in commonly-assigned, copending U.S. patent application, Ser. No. 08/890,463 filed on even date herewith.

The photosensitive system referred to above comprises a photosensitive silver halide emulsion. In a preferred color embodiment of the invention a corresponding image dye-providing material is provided in conjunction with the silver halide emulsion. The image dye-providing material is capable of providing, upon processing, a diffusible dye which is capable of diffusing to the image-receiving layer as a function of exposure. As described previously, preferred photographic diffusion transfer film units are intended to provide multicolor dye images and the photosensitive element is preferably one capable of providing such multicolor dye images. In a preferred black and white embodiment, the image-forming material utilized is complexed silver which diffuses from the photosensitive element to the image-receiving layer during processing. Moreover, the image-receiving layer utilized in such black and white embodiments typically includes silver nucleation materials. As stated earlier, both such photosensitive systems are well known in the art.

Briefly, however, in the black and white diffusion transfer film units of the present invention, a photosensitive element including a photosensitive silver halide emulsion is exposed to light and subjected to an aqueous alkaline solution comprising a silver halide developing agent and a silver halide solvent. The developing agent reduces exposed silver halide to an insoluble form and the unexposed silver halide, solubilized by the silver solvent, migrates to an image-receiving element. The image-receiving element of these film units typically comprises a support and an image-receiving layer including a silver precipitating material such as that referred to above wherein the soluble silver complex is precipitated or reduced to form a visible silver black and white image. The binder material for the overcoat layer in black and white embodiments should be permeable to the photographic alkaline processing fluid and to complexed silver salt which transfers to the image-receiving layer to provide an image. Examples of such black and white photographic film units are disclosed in U.S. Pat. Nos. 3,567,442; 3,390,991 and 3,607,269 and in E. H. Land, H. G. Rogers, and V. K. Walworth, in J. M. Sturge, ed., *Neblette's Handbook of Photography and Reprography*, 7th ed., Van Nostrand Reinhold, New York, 1977, pp. 258–330.

As mentioned previously, preferably, the photosensitive element of the invention includes a polymeric acid-reacting layer. The polymeric acid-reacting layer reduces the environmental pH of the film unit, subsequent to transfer image formation. As disclosed, for example, in U.S. Pat. No. 3,362,819, the polymeric acid-reacting layer may comprise a nondiffusible acid-reacting reagent adapted to lower the pH from the first (high) pH of the processing composition in which the image material (e.g. image dyes) is diffusible to a second (lower) pH at which they are not diffusible. The acid-reacting reagent is preferably a polymer which contains acid groups, e.g., carboxylic acid or sulfonic acid groups, which are capable of forming salts with alkaline metals or with organic bases, or potentially acid-yielding groups such as anhydrides or lactones. Thus, reduction in the environmental pH of the film unit is achieved by the conduct of a neutralization reaction between the alkali provided by the processing composition and a layer which comprises immobilized acid-reactive sites and which functions as a neutralization layer. Preferred polymers such a neutralization layer comprise such polymeric acids as cellulose acetate hydrogen phthalate; polyvinyl hydrogen phthalate; polyacrylic acid; polystyrene sulfonic acid; and maleic anhydride copolymers and half esters thereof.

Further, a polymeric acid-reacting layer can be applied, if desired, by coating the support layer with an organic solvent-based or water-based coating composition. A polymeric acid-reacting layer which is typically coated from an organic-based composition comprises a mixture of a half butyl ester of polyethylene/maleic anhydride copolymer with polyvinyl butyral. A suitable water-based composition for the provision of a polymeric acid-reacting layer comprises a mixture of a water soluble polymeric acid and a water soluble matrix, or binder, material. Suitable water-soluble polymeric acids include ethylene/maleic anhydride copolymers and poly(methyl vinyl ether/maleic anhydride). Suitable water-soluble binders include polymeric materials such as polyvinyl alcohol, partially hydrolyzed polyvinyl acetate, carboxymethyl cellulose, hydroxyethyl cellulose, hydroxypropyl cellulose, polymethylvinylether or the like, as described in U.S. Pat. No. 3,756,815. As examples of useful polymeric acid-reacting layers, in addition to those disclosed in the U.S. Pat. Nos. 3,362,819 and 3,756,815, mention may be made of those disclosed in U.S. Pat. Nos. 3,415,644; 3,754,910; 3,765,885; 3,819,371 and 3,833,367. Further, the polymeric acid-reacting layer may include inosine as disclosed and claimed in commonly-assigned, copending U.S. patent application, Ser. No. 08/890,463 filed on even date herewith.

Any suitable inert interlayer or spacer layer may be used in association with the polymeric acid layer to control or "time" the pH reduction so that it is not premature which would interfere with the development process. Suitable spacer or "timing" layers useful for this purpose are described with particularity in U.S. Pat. Nos. 3,362,819; 3,419,389; 3,421,893; 3,455,686; 3,575,701; 4,201,587; 4,288,523; 4,297,431; 4,391,895; 4,426,481; 4,458,001; 4,461,824; 4,457,451 and 5,593,810.

As mentioned earlier, any suitable image-receiving layer which is designed for receiving an image-forming material which diffuses in an imagewise manner from the photosensitive element during processing may be used in the present invention. In color embodiments of the present invention, the image-receiving layer generally comprises a dyeable material which is permeable to the alkaline processing composition. The dyeable material may comprise polyvinyl alcohol together with a polyvinyl pyridine polymer such as poly(4-vinyl pyridine). Such image-receiving layers are further described in U.S. Pat. No. 3,148,061.

Another suitable image-receiving layer material comprises a graft copolymer of 4-vinyl pyridine and vinylbenzyltrimethylammonium chloride grafted onto hydroxyethyl cellulose. Such graft copolymers and their use as image-receiving layers are further described in U.S. Pat. Nos. 3,756,814 and 4,080,346. Other suitable materials can, however, be employed.

For example, suitable mordant materials of the vinylbenzyltrialkylammonium type are described, for example, in U.S. Pat. No. 3,770,439. Mordant polymers of the hydrazinium type (such as polymeric mordants prepared by quaternization of polyvinylbenzyl chloride with a disubstituted asymmetric hydrazine), e.g., those described in Great Britain Patent No. 1,022,207, published Mar. 9, 1966, can also be employed. One such hydrazinium mordant is poly (1-vinylbenzyl 1,1-dimethylhydrazinium chloride) which, for example, can be admixed with polyvinyl alcohol for provision of a suitable image-receiving layer.

Yet another suitable mordant material is a terpolymer comprising trimethyl-, triethyl- and tridodecylvinylbenzylammonium chloride, as described, for example, in U.S. Pat. Nos. 4,794,067; 5,591,560; and 5,593,809.

As stated earlier, the image-receiving element of the invention may also include an overcoat layer, such as, for example, described in U.S. Pat. Nos. 5,415,969 and 5,633,114. Such an overcoat layer comprises a majority by dry weight of water-insoluble particles and a minority by dry weight of a binder material. The particles are substantially insoluble in water and non-swellable when wet. Furthermore, in order to minimize any light scatter by the overcoat layer, the particles typically have a small average particle size, for example, less than 300 mm and preferably less than 100 nm, and more preferably in the range of about 1 nm to 50 nm. The water-insoluble particles may comprise inorganic materials, e.g. colloidal silica, and/or organic materials, e.g. water-insoluble polymeric latex particles such as an acrylic emulsion resin. Colloidal silica is the preferred inorganic particle for use in such an overcoat layer, however, other inorganic particles may be used in combination or substituted therefor.

The binder material for the overcoat layer preferably comprises a water-insoluble latex material, however, the layer may comprise water soluble materials or combinations of water-insoluble and water soluble materials. Examples of applicable water soluble binder materials include ethylene acrylic acid, polyvinyl alcohol, gelatin, and the like.

One or more overcoat layers may be used in combination with other layers. Typically, each overcoat layer has a thickness of up to about 2 microns, and preferably between 1 and 1.5 microns. Such overcoat layers must allow sufficient image-providing material to be transferred to the image-receiving layer to provide a photograph of the desired quality. In an embodiment wherein the overcoat layer(s) remains upon the image-receiving element after processing and separation from the photosensitive element, the overcoat layer(s) should not scatter visible light to any appreciable degree since the photograph will be viewed through such layer(s).

In a preferred embodiment of the present invention the image-receiving element includes a layer comprising a copolymer of Petrolite® D300, which is commercially available from Petrolite Corporation (Tulsa, Okla.), and Polyox N3K, which is commercially available from Union Carbide Corporation (Danbury, Conn.), at a ratio of about 3:1, respectively, and Aerosol-OS, which is commercially available from American Cyanamid Corporation (Stamford, Conn.).

The invention will now be described further in detail with respect to specific preferred embodiments by way of examples, it being understood that these are intended to be illustrative only and the invention is not limited to the materials, conditions, process parameters, etc. recited therein. All parts and percentages recited are by weight unless otherwise stated.

EXAMPLE I

Two diffusion transfer photographic film units were prepared: one "test-1" film unit, i.e., a film unit prepared according to an embodiment of the present invention, and one "control-1" film unit, i.e., a film unit prepared in the same overall manner as the test film units but without the polyoxyethylene stearate in the clearing layer. More specifically, as will be described in detail below, the image-receiving element of the "test-1" film unit prepared according to an embodiment of the present invention included a layer comprising nonylphenoxypolyoxyethylene, available from the General Dyestuff Corporation under the tradename Igepal® CO-997, polyoxyethylene stearate, available from ICI Americas, Inc. under the tradename Myrj® 59, and poly-N-vinyl-pyrrolidone, available from GAF Corp. under the tradename Type NP K-120.

The photosensitive elements used in both of the photographic film units described above comprised an opaque subcoated polyethylene terephthalate photographic film base carrying in succession:

1. a polymeric acid-reacting layer coated at a coverage of about 24,212 mg/m$^2$ comprising a 1.2/1 ratio of AIR-FLEX® 465 (a vinyl acetate ethylene latex available from Air Products Co.) and GANTREZ® S-97 (a free acid of a copolymer of methyl vinyl ether and maleic anhydride available from GAF Corp.);
2. a timing layer coated at a coverage of about 4075.5 mg/m$^2$ comprising 4026.6 mg/m$^2$ of a copolymer of diacetone acrylamide and acrylamide grafted onto polyvinyl alcohol and 48.9 mg/m$^2$ of Aerosol-OS;
3. a cyan dye developer layer comprising about 500 mg/m$^2$ of the cyan dye developer represented by the formula

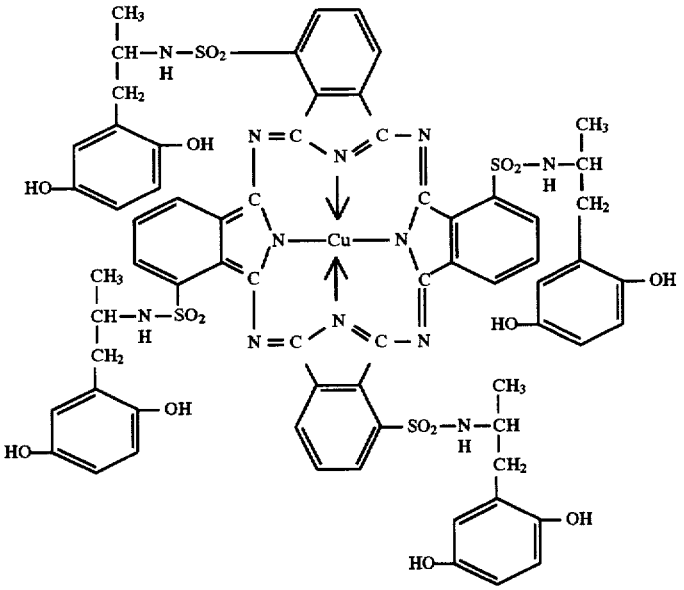

about 274 mg/m$^2$ of gelatin, and about 184 mg/m$^2$ of methylphenylhydroquinone

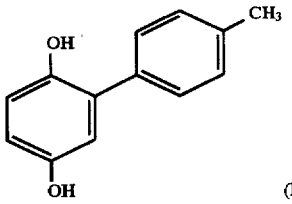

(MPHQ);

4. an interlayer comprising about 1000 mg/m$^2$ of titanium dioxide, about 374 mg/m$^2$ of a dispersion of polymethylmethacrylate beads (about 0.2 μm), about 124 mg/m$^2$ of gelatin, and about 374 mg/m$^2$ of a copolymer of butyl acrylate/diacetone acrylamide/methacrylic acid/styrene/acrylic acid;

5. a red-sensitive silver iodobromide layer comprising about 157 mg/m$^2$ of silver iodobromide (0.7 μm), about 525 mg/m$^2$ of silver iodobromide (1.5 μm), about 367 mg/m$^2$ of silver iodobromide (1.8 μm) and about 600 mg/m$^2$ of gelatin;

6. an interlayer comprising about 2976 mg/m$^2$ of a copolymer of butyl acrylate/diacetone acrylamide/methacrylic acid/styrene/acrylic acid and about 124 mg/m$^2$ of succindialdehyde;

7. a magenta dye developer layer comprising about 300 mg/m$^2$ of a magenta dye developer represented by the formula

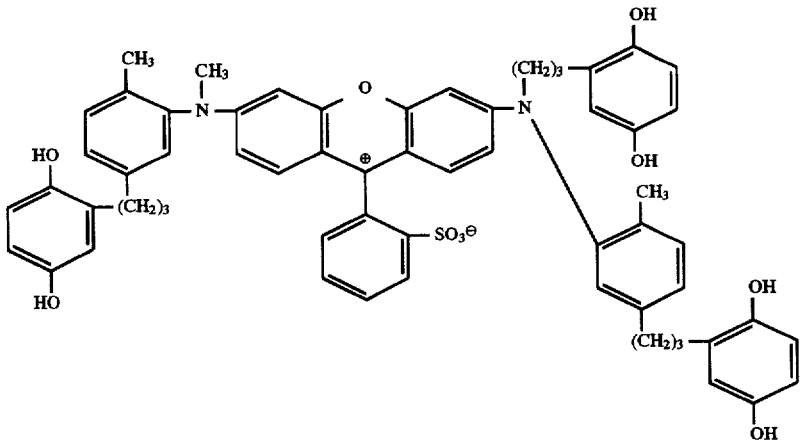

about 30 mg/m$^2$ of benzylaminopurine, about 200 mg/m$^2$ of a releasable antifoggant

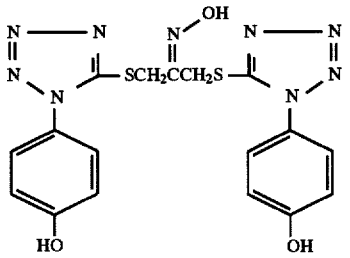

about 200 mg/m$^2$ of 2-phenyl benzimidazole and about 292 mg/m$^2$ of gelatin;

8. a layer comprising about 900 mg/m$^2$ of titanium dioxide, about 337 mg/m$^2$ of a dispersion of polymethylmethacrylate beads (about 0.2 μm), about 112 mg/m$^2$ of gelatin and about 337 mg/m$^2$ a copolymer of butyl acrylate/diacetone acrylamide/methacrylic acid/styrene/acrylic acid;

9. a green-sensitive silver iodobromide layer comprising about 220 mg/m$^2$ of silver iodobromide (1.1 μm), about 660 mg/m$^2$ of silver iodobromide (1.3 μm), about 220 mg/m$^2$ of silver iodobromide (1.5 μm) and about 484 mg/m$^2$ of gelatin;

10. a spacer layer comprising about 300 mg/m$^2$ tricrestylphosphate, about 136 mg/m$^2$ of MPHQ, about 136 mg/m$^2$ of a lactone developer represented by the formula

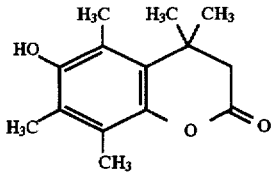

and about 249 mg/m$^2$ of gelatin;

11. an interlayer comprising about 1248 mg/m$^2$ of a copolymer of butyl acrylate/diacetone acrylamide/methacrylic acid/styrene/acrylic acid, and about 52 mg/m$^2$ of succindialdehyde;

12. a layer comprising about 1200 mg/m$^2$ of a scavenger (1-octadecyl-4,4-dimethyl-2-[2-hydroxy-5-(N-(7-caprolactamido)sulfonamido-phenyl]thiazolidine) and about 696 mg/m$^2$ of gelatin;

13. a yellow filter layer comprising about 400 mg/m$^2$ of a benzidine yellow dye, about 400 mg/m$^2$ of a polyvinylalcohol (Airvol® 325, available from Air Products Co.) and about 150 mg/m$^2$ of a hardener (available from R.H.Sands Corp. under the tradename OB 1207);

14. a yellow image dye-providing layer comprising about 420 mg/m$^2$ of a yellow image dye-providing material represented by the formula

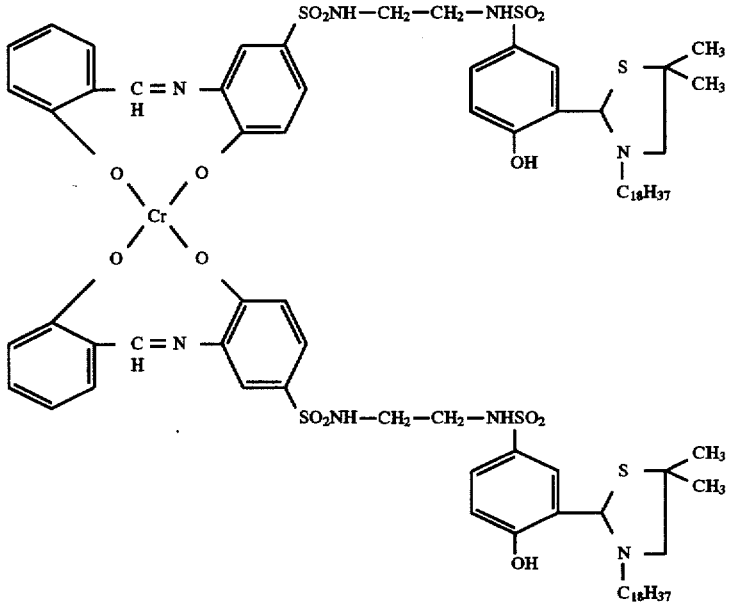

dispersed in Airvol, and about 280 mg/m$^2$ of gelatin;

15. a layer coated at a coverage of about 412 mg/m$^2$ of a tertoctylhydroquinone, about 206 mg/m$^2$ of dimethylterephthalamide, about 45 mg/m$^2$ of an oxidative release restrainer compound (available from Fairmont Chemical, Inc.) and about 300 mg/m$^2$ of gelatin;

16. a blue-sensitive silver iodobromide layer comprising about 235 mg/m$^2$ of silver iodobromide (1.3 μm) and about 118 mg/m$^2$ of gelatin; and 17. a layer comprising about 450 mg/m$^2$ of a dispersion of polymethylmethacrylate beads (about 0.2 μm), and about 350 mg/m$^2$ of gelatin.

U.S. Pat. No. 5,571,656 discloses and claims the use of the lactone developer included in layer 10 above in diffusion transfer photographic film units.

The image-receiving element used in the "control-1" photographic film unit comprised a transparent subcoated polyethylene terephthalate photographic film base carrying in succession:

1. an image-receiving layer coated at a coverage of about 2798 mg/m$^2$ comprising 2 parts of a terpolymer comprising vinylbenzyltrimethylammonium chloride, vinylbenzyltriethylammonium chloride and vinylbenzyldimethyldodecylammonium chloride (6.7/3.3/1 weight %, respectively) and 1 part of gelatin, about 12.5 mg/m$^2$ of dimethyl-2,4-imidazolinedione, about 53.8 mg/m$^2$ of ammonium nitrate and about 10.8 mg/m$^2$ of polymethylmethacrylate beads (available from Anitec Image, 4–7 micron),
2. a layer coated at a coverage of about 810 mg/m$^2$ comprising about 540 mg/m$^2$ of Igepal® CO-997 and about 270 mg/m$^2$ of Type NP K-90; and
3. a layer coated at a coverage of about 430 mg/m$^2$ comprising about 323 mg/m$^2$ of Petrolite® (D300) and about 108 mg/m$^2$ of Polyox N3K, a ratio of about 3:1, respectively, and about 21.5 mg/m$^2$ of 0.1% of Aerosol-OS.

The image-receiving element utilized in the "test-1" diffusion transfer photographic film unit was prepared in the same overall manner as described above except that layer 2 was a layer coated at a coverage of about 810 mg/m$^2$ comprising about 215 mg/m$^2$ of Igepal® CO-997, about 270 mg/m$^2$ of Type NP K-90, and about 325 mg/m$^2$ of Myrj® 59.

The example film units were prepared utilizing the image-receiving elements and photosensitive elements as described above. In each case, after photoexposure of the photosensitive element, the image-receiving element and the photosensitive element were arranged in face-to-face relationship, i.e. (with their respective supports outermost) and a rupturable container containing an aqueous alkaline processing composition was affixed between the image-receiving and photosensitive elements at the leading edge of each film unit such that the application of compressive pressure to the container would rupture the seal of the container along its marginal edge and distribute the contents uniformly between the respective elements. The chemical composition of the aqueous alkaline processing composition utilized for the processing of the film units is set forth in TABLE I.

TABLE I

| COMPONENT | PARTS BY WEIGHT |
|---|---|
| optical filter agent ((f) herein) | 1.10 |
| 4-methyl-benzenesulfinic acid | 1.00 |
| 6-methyluracil | 0.59 |
| hydrophobically modified polyacrylic acid | 1.20 |
| trans-4-(aminoethyl)cyclohexane carboxylic acid | 0.15 |
| 2-amino-1,7-dihydro-6H-purine-6-one | 0.25 |
| potassium hydroxide | 5.92 |
| silica, aqueous dispersion | 0.31 |
| 1-(4-hydroxyphenyl)-2-tetrazoline-5-thione | 0.02 |
| optical filter agent ((d) herein) | 0.13 |
| 1-(phenyl-N-propyl)-2-ethylpyridinium bromide, 50% aqueous solution | 0.07 |
| 1H-1,2,4-triazole | 0.18 |
| 2-ethyl-1-(2-dioxanylethyl)pyridinium bromide, 50% aqueous solution | 1.06 |
| titanium dioxide | 42.0 |
| hypoxanthine | 0.76 |
| 2-ethyl-1H-imidazole | 1.68 |

TABLE I-continued

| COMPONENT | PARTS BY WEIGHT |
|---|---|
| optical filter agent ((c) herein) | 0.11 |
| water | balance to 100 |

Each film unit, after exposure to a sensitometric target, was passed through a pair of rollers set at a gap spacing of about 0.007 mm at room temperature, the final image was viewed through the transparent support.

Upon visual examination of each of the film units during about the first five minutes of photographic processing thereof, the "test-1" film unit allowed the viewing of the emerging image against or through a whiter, brighter background than that of the "control-1" film unit.

The red, blue and green maximum ($D_{max}$) and minimum ($D_{min}$) reflection densities which were read on a MacBeth Densitometer are shown in TABLE II below.

TABLE II

| | RED | | GREEN | | BLUE | |
|---|---|---|---|---|---|---|
| FILM UNIT | $D_{max}$ | $D_{min}$ | $D_{max}$ | $D_{min}$ | $D_{max}$ | $D_{min}$ |
| Control-1 | 184 | 0.15 | 198 | 0.19 | 169 | 0.14 |
| Test-1 | 188 | 0.15 | 201 | 0.18 | 170 | 0.13 |

It will be understood from the $D_{max}$ data reported in TABLE II herein that both image-receiving elements allow sufficient image dye-providing materials to diffuse to the image-receiving layer. Also, it will be appreciated from the $D_{min}$ data of TABLE II herein that both image-receiving elements provide photographs with acceptable backgrounds.

EXAMPLE II

Two "test" sheets, i.e., "test-2" and "test-3," were prepared by coating on a transparent film base, in order:

1. an image-receiving layer coated at a coverage of about 2798 mg/m$^2$ and comprising 2 parts of a terpolymer comprising vinylbenzyltrimethylammonium chloride, vinylbenzyltriethylammonium chloride and vinylbenzyldimethyldodecylammonium chloride (6.7/3.3/1 weight %, respectively) and 1 part of gelatin, about 12.5 mg/m$^2$ of dimethyl-2,4-imidazolinedione, about 53.8 mg/m$^2$ of ammonium nitrate and about 10.8 mg/m$^2$ of polymethylmethacrylate beads (available from Anitec Image, 4–7 micron); and
2. a layer prepared according to an embodiment of the present invention, e.g., a layer comprising nonylphenoxypolyoxyethylene (Igepal® CO-997 or "Igepal"), polyoxyethylene stearate (Myrj® 59 or "Myrj") and poly-N-vinyl-pyrrolidone (Type NP K-120), at a ratio of about 3.5 parts of clearing agents (collectively) to about 1 part Type NP K-120, at a total coverage of about 1076 mg/m$^2$).

In addition, two "control" sheets, i.e., "control-I" and "control-M," were prepared in the same overall manner as the "test-2" and "test-3" sheets but wherein layer 2 included either Igepal ("control-I") or Myrj ("control-M") but not both materials.

The test-2, test-3, control-I and control-M sheets were each sandwiched with an exposed photosensitive element prepared as described in Example I herein and a processing composition prepared as described for the "control-1" film unit of Example I herein. The sandwiches were processed through a pair of rollers set at a gap spacing of about 71 μm at room temperature. A Minolta Colorimeter Model CR-231 was positioned above and over the sandwiches to record the whiteness values, or "L*" as is well known in the art, about every 15 seconds for about the first five minutes of processing. The average L* value (whiteness) for each sandwich was calculated by taking the average of the initial reading and the final reading during the five minute period, and are reported in TABLE III.

TABLE III

| LAYER | CLEARING AGENT (% by weight)[1] IGEPAL | MYRJ | WHITENESS |
|---|---|---|---|
| control-I | 100 | 0 | 79.7 |
| test-2 | 40 | 60 | 80.5 |
| test-3 | 25 | 75 | 81.8 |
| control-M | 0 | 100 | 76.9 |

[1]As indicated above, the amount of clearing agents (collectively) to binder material (poly-N-vinylpyrrolidone) is kept constant in the layers as defined, i.e., about 3.5:1, clearing agents:binder. For example, for "control-I," the clearing agent of this layer was 100% Igepal, whereas for "test-2," the clearing agent was a combination of about 40% Igepal and about 60% Myrj.

As would be understood by those of skill in the art from the data reported in TABLE III herein, a layer comprising polyoxyethylene stearate, i.e., control-M, provides less initial clearing, i.e., a significantly lower L* or whiteness against which the emerging image is viewed, than a layer comprising nonylphenoxypolyoxyethylene, i.e., control-I.

As would also be understood by those of skill in the art from the data of TABLE III herein, in particular, the significantly lower L* or whiteness value reported for control-I compared with the L* values reported for "test-2" and "test-3," the initial clearing, i.e., in about the first five minutes of processing, by a layer comprising nonylphenoxypolyoxyethylene is augmented when polyoxyethylene stearate is further included therein.

EXAMPLE III

Two sheets were prepared as described in Example II, more specifically, a "test-4" sheet was prepared as described for "test-2" and "test-3" in Example II, and a "control-2" sheet was prepared by coating on a transparent film base, in order:

1. an image-receiving layer coated at a coverage of about 2798 mg/m$^2$ and comprising 2 parts of a terpolymer comprising vinylbenzyltrimethylammonium chloride, vinylbenzyltriethylammonium chloride and vinylbenzyldimethyldodecylammonium chloride (6.7/3.3/1 weight %, respectively) and 1 part of gelatin, about 12.5 mg/m$^2$ of dimethyl-2,4-imidazolinedione, about 53.8 mg/m$^2$ of ammonium nitrate and about 10.8 mg/m$^2$ of polymethylmethacrylate beads (available from Anitec Image, 4–7 micron); and
2. a layer comprising nonylphenoxypolyoxyethylene (Igepal® CO-997 or "Igepal") and poly-N-vinylpyrrolidone (Type NP K-120), at a ratio of about 3.5 parts of Igepal to about 1 part Type NP K-120, at a total coverage of about 1076 mg/m$^2$).

A light source was shown through the transparent film base of each of the sheets, and the percentage (%) of light transmitted versus diffracted was determined using a Gardener Hazemeter, and the data are reported in TABLE IV.

TABLE IV

| SHEET | % HAZE |
|---|---|
| control-2 | about 4.3 |
| test-4 | about 3.6 |

As would be appreciated by one of skill in the art, in diffusion transfer photographic film units wherein the photoexposure takes place through a transparent support of an image-receiving element, the presence of haze in the film coating(s) carried by the transparent support would cause the exposure therethrough to be less than optimal, i.e., a portion of the light comprising the exposure would be diffracted, and, therefore, the final image of the finished photograph would be visibly less sharp.

As would be understood by those of skill in the art from the data reported in TABLE IV herein, the use of the clearing layer of the present invention, i.e., "test-4," results in less of the incident light being diffracted, or, more specifically, an appreciable, i.e., about a 20%, reduction or lowering of haze. The reduction in haze of the film coatings through which the exposure occurs results in improved clarity in the film coatings and, as visually observed, a sharper final image therefrom.

Although the invention has been described in detail with respect to various preferred embodiments thereof, those skilled in the art will recognize that the invention is not limited thereto but rather that variations and modifications can be made which are within the spirit of the invention and the scope of the appended claims.

What is claimed is:

1. An image receiving element for use in diffusion transfer process comprising a support carrying on the support:

an image-receiving layer; and a clearing layer over said image-receiving layer, remote from said support, said clearing layer comprising nonylphenoxypolyoxyethylene and polyoxyethylene stearate.

2. An image-receiving element as defined in claim 1 wherein said clearing layer is adjacent to said image-receiving layer.

3. An image-receiving element as defined in claim 1 wherein said clearing layer further includes a binder material.

4. An image-receiving element as defined in claim 3 wherein said binder material is poly-N-vinylpyrrolidone.

5. An image-receiving element as defined in claim 1 wherein the weight ratio of said nonylphenoxypolyoxyethylene to said polyoxyethylene stearate is from about 1:9 to about 3:7.

6. An image-receiving element as defined in claim 5 wherein said weight ratio is about 1:1.5.

7. An image-receiving element as defined in claim 3 wherein said weight ratio said nonylphenoxypolyoxyethylene to said polyoxyethylene stearate is from about 1:9 to about 3:7.

8. An image-receiving element as defined in claim 7 wherein said weight ratio is about 1:1.5.

9. An image-receiving element as defined in claim 3 wherein the weight ratio of said nonylphenoxypolyoxyethylene and said polyoxyethylene stearate, taken together, to said binder material is from about 4:1 to about 1.5:1.

10. An image-receiving element as defined in claim 1 wherein said nonylphenoxypolyoxyethylene is represented by the formula

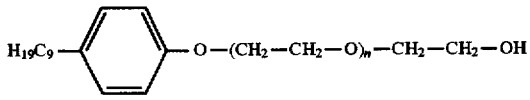

wherein: n is an integer from about 40 to about 120.

11. An image-receiving element as defined in claim 1 wherein said polyoxyethylene stearate is represented by the formula

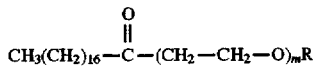

wherein: R is selected from the group consisting of: $^{-}OOC-(CH_2)_{16}CH_3$ and $-CH_2-CH_2-OH$; m is an integer from about 40 to about 180, when R is $-CH_2-CH_2-OH$; and m is an integer from about 40 to about 200 when R is $^{-}OOC-(CH_2)_{16}CH_3$.

12. An image-receiving element as defined in claim 10 wherein said polyoxyethylene stearate is represented by the formula

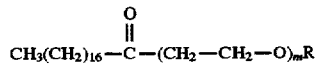

wherein: R is selected from the group consisting of $^{-}OOC-(CH_2)_{16}CH_3$ and $-CH_2-CH_2-OH$; m is an integer from about 40 to about 180, when R is $-CH_2-CH_2-OH$; and m is an integer from about 40 to about 200 when R is $^{-}OOC-(CH_2)_{16}CH_3$.

13. An image-receiving element as defined in claim 10 wherein n is an integer from about 80 to about 120.

14. An image-receiving element as defined in claim 10 wherein n is an integer from about 90 to about 110.

15. An image-receiving element as defined in claim 11 wherein R is $^{-}OOC-(CH_2)_{16}CH_3$.

16. An image-receiving element as defined in claim 11 wherein R is $-CH_2-CH_2-OH$.

17. An image-receiving element as defined in claim 12 wherein m is an integer from about 80 to about 160.

18. An image-receiving element as defined in claim 1 wherein said clearing layer comprises from about 9% by weight to about 55% of nonylphenoxypolyoxyethylene and from about 25% by weight to about 75% of polyoxyethylene stearate.

19. An image-receiving element as defined in claim 3 wherein said clearing layer comprises from about 20% by weight to about 35% of binder material.

20. An image-receiving element as defined in claim 4 wherein said clearing layer comprises from about 9% by weight to about 55% of nonylphenoxypolyoxyethylene, from about 25% by weight to about 75% of polyoxyethylene stearate and from about 20% by weight to about 35% of poly-N-vinylpyrrolidone.

21. A diffusion transfer photographic film unit which comprises:

a photosensitive element comprising a support carrying at least one silver halide emulsion layer;

an image-receiving element comprising a support carrying an image-receiving layer and a clearing layer over said image-receiving layer, remote from said support of said image-receiving element, said clearing layer comprising nonylphenoxypolyoxyethylene and polyoxyethylene stearate; and means providing an aqueous alkaline processing composition for initiating development of said silver halide emulsion after photoexposure.

22. A diffusion transfer photographic film unit as defined in claim 21 further including an image dye-providing material in association with said silver halide emulsion layer.

23. A diffusion transfer photographic film unit as defined in claim 21 wherein said clearing layer is adjacent to said image-receiving layer.

24. A diffusion transfer photographic film unit as defined in claim 21 wherein said clearing layer further includes a binder material.

25. A diffusion transfer photographic film unit as defined in claim 24 wherein said binder material is poly-N-vinylpyrrolidone.

26. A diffusion transfer photographic film unit as defined in claim 21 wherein the weight ratio of said nonylphenoxypolyoxyethylene to said polyoxyethylene stearate is from about 1:9 to about 3:7.

27. A diffusion transfer photographic film unit as defined in claim 24 wherein said weight ratio said nonylphenoxypolyoxyethylene to said polyoxyethylene stearate is from about 1:9 to about 3:7.

28. A diffusion transfer photographic film unit as defined in claim 24 wherein the weight ratio of said nonylphenoxypolyoxyethylene and said polyoxyethylene stearate, taken together, to said binder material is from about 4:1 to about 1.5:1.

29. A diffusion transfer photographic film unit as defined in claim 21 wherein said nonylphenoxypolyoxyethylene is represented by the formula

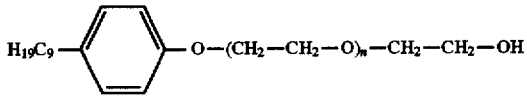

wherein: n is an integer from about 40 to about 120.

30. A diffusion transfer photographic film unit as defined in claim 21 wherein said polyoxyethylene stearate is represented by the formula

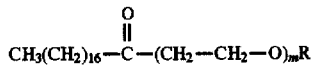

wherein: R is selected from the group consisting of $^{-}OOC-(CH_2)_{16}CH_3$ and $-CH_2-CH_2-OH$; m is an integer from about 40 to about 180, when R is $-CH_2-CH_2-OH$; and m is an integer from about 40 to about 200 when R is $^{-}OOC-(CH_2)_{16}CH_3$.

31. A diffusion transfer photographic film unit as defined in claim 29 wherein said polyoxyethylene stearate is represented by the formula

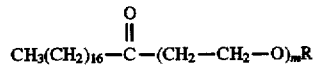

wherein: R is selected from the group consisting of: $^{-}OOC-(CH_2)_{16}CH_3$ and $-CH_2-CH_2-OH$; m is an integer from about 40 to about 180, when R is $-CH_2-CH_2-OH$; and m is an integer from about 40 to about 200 when R is $^{-}OOC-(CH_2)_{16}CH_3$.

32. A diffusion transfer photographic film unit as defined in claim 21 wherein said clearing layer comprises from about 9% by weight to about 55% of nonylphenoxypolyoxyethylene and from about 25% by weight to about 75% of polyoxyethylene stearate.

33. A diffusion transfer photographic film unit as defined in claim 24 wherein said clearing layer comprises from about 20% by weight to about 35% of binder material.

34. A diffusion transfer photographic film unit as defined in claim 24 wherein said clearing layer comprises from about 9% by weight to about 55% of nonylphenoxypolyoxyethylene, from about 25% by weight to about 75% of polyoxyethylene stearate and from about 20% by weight to about 35% of poly-N-vinylpyrrolidone.

35. A method for forming a diffusion transfer image which comprises the steps of:

preparing a diffusion transfer photographic film unit comprising a photosensitive element and an image-receiving element, said photosensitive element comprising a support carrying at least one silver halide emulsion layer, said image-receiving element comprising a support carrying an image-receiving layer and a layer comprising nonylphenoxypolyoxyethylene and polyoxyethylene stearate;

exposing said film unit to an imagewise pattern of radiation;

developing said film unit by providing a layer of aqueous alkaline processing composition comprising a light-reflecting pigment and a light-absorbing optical filter agent between said photosensitive element and said image-receiving element;

reducing the light-absorbing capacity of said light-absorbing optical filter agent comprising said processing composition whereby the surface of said layer of said processing composition viewable through said support appears substantially white substantially immediately after said layer of said processing composition is applied; and forming an image on said image-receiving layer.

* * * * *